US006557713B1

(12) United States Patent
Laenge

(10) Patent No.: US 6,557,713 B1
(45) Date of Patent: May 6, 2003

(54) ROTARY CRANE

(75) Inventor: Walter Laenge, Ludesch (AT)

(73) Assignee: Liebherr-Werk Nenzing GmbH, Neuzing (AT)

( * ) Notice: Subject to any disclaimer, the term of this patent is extended or adjusted under 35 U.S.C. 154(b) by 0 days.

(21) Appl. No.: 09/855,276

(22) Filed: May 15, 2001

(51) Int. Cl.[7] ..... B66C 23/84
(52) U.S. Cl. ..... 212/253
(58) Field of Search ..... 212/253

(56) References Cited

U.S. PATENT DOCUMENTS 4,184,600 A * 1/1980 Goss et al. ..... 212/253
4,652,177 A * 3/1987 Gunther et al. ..... 212/253
5,310,067 A * 5/1994 Morrow ..... 212/253
5,328,040 A 7/1994 Morrow

* cited by examiner

*Primary Examiner*—Thomas J. Brahan
(74) *Attorney, Agent, or Firm*—Dilworth & Barrese LLP

(57) ABSTRACT

This invention concerns a rotary crane, especially an offshore crane of the king post type. The rotary crane has a pylon which can be anchored on a floor plate, platform, or similar equipment, a turntable housed to revolve around the longitudinal axis of the pylon by means of an upper support and a lower support, a crane boom supported by the turntable, and rotating gear for rotating the turntable around the pylon. The upper support has a mount which is positioned on the peak of the pylon and which can rotate, which mount has an axial support surface for axial support on the pylon as well as a radial support surface for radial support on the pylon, and suspension equipment for suspending the turntable. According to the invention, on the pylon there is an inclined plane, and there is on the mount a lifting component which can be anchored, which lifting component runs around the longitudinal axis of the pylon along the inclined plane when the mount is rotated and lifts the mount with its axial support surface off the pylon.

16 Claims, 7 Drawing Sheets

ROTARY CRANE

BACKGROUND OF THE INVENTION

The present invention concerns a rotary crane, especially an offshore crane of the king post type, with a pylon which can be anchored to a base plate, platform, etc., a turntable mounted to revolve on the longitudinal axis of the pylon, a crane boom borne by the turntable, and rotating gear for rotating the turntable on the pylon, where the upper support of the turntable includes a mount seated on an upper section of the pylon, in such a manner that it can be rotated, which upper mount has an axial support surface to brace axially against the pylon, as well as a radial support surface to brace radially against the pylon, and suspension means to suspend the turntable.

A rotary crane of the king post type is known from U.S. Pat. No. 5,328,040. The support pylon or king post of this crane has at its upper end a support pin which protrudes from the front of the pylon. A mount 34 is positioned on and can rotate around this support pin, on which the turntable of the crane is supported. For this purpose the mount has two upright, approximately circular, support discs 38 which face each other. The turntable is positioned on these circular-arc support discs with appropriate matching counter-components, so that the axial forces acting on the mount or the upper support are centered. In addition to said mount, the turntable is supported radially on the upper support via a pin positioned radially to the support pin and a corresponding radial support, to support the horizontal components of the support force.

This known support method can be improved from several points of view. Particularly disadvantageous is the fact that it is a support design that is expensive, as a whole. It is relatively difficult to maintain, as the multi-part construction has to be disassembled. To gain access to the upper support, the entire turntable has to be raised. This requires hydraulic jacks, for which in turn appropriate contact points in the form of flanges and the like must be welded on.

Another problem is the strength and security of this support. Ultimately the entire burden created by the turntable, pylon, and lift load depends on four screws which hold the pertinent parts of the upper support together. This is urgently in need of improvement from the aspect of safe force application.

The task of the present invention is therefore to create an improved rotary crane of said type which avoids the disadvantages of the state of the art and further develops it in an advantageous fashion. Especially, an improved upper support is to be created for the turntable on the rotary pylon which, on the one hand, is simple in construction and simple to maintain and, on the other hand, permits a safe transfer of forces from the turntable to the pylon.

According to the invention, this problem is solved by a rotary crane, especially an offshore crane, of the king post type, with a pylon which can be anchored on a floor plate, platform, and similar equipment, a turntable housed to revolve on the longitudinal axis of the pylon by means of an upper support and a lower support, a crane boom supported by the turntable, and rotating gear for rotating the turntable on the pylon, in which the upper support of the rotary stage has a mount which is positioned on an upper end section of the pylon and which can rotate, which mount has an axial support surface for axial support on the pylon as well as a radial support surface for radial support on the pylon and suspension equipment for suspending the turntable, in which an inclined plane is provided on the pylon and a lifting component can be attached to the mount, which lifting component runs along side the inclined plane when the support is rotated on the longitudinal axis of the pylon, lifting the mount with its axial support surface from the pylon. Preferred embodiments of are described herein.

The rotary crane thus has a wedge-shaped surface on the pylon, and, on the mount, an attachment device for attaching a hoisting device which, when the mount rotates on the longitudinal axis of the pylon, runs along the pylon inclined plane and lifts the mount with its axial support surface from the pylon. This facilitates access to the support in a particularly simple manner. After the attachment of the lifting component to the mount, all that is needed is to activate the rotating gear so that the turntable and the mount, which is fixed immovably to the pylon revolve on the pylon with respect to the longitudinal axis of the pylon. The lifting component thereby makes contact with the screw-pitch inclined plane on the pylon, and lifts the mount and with it the entire turntable around a piece on the pylon, in such manner that the axial support surfaces come free and are accessible for maintenance. The lower support, as well as the rotating gear drive, are designed in such manner that they can slide axially for this purpose.

Conversely, another aspect of the present invention can provide for the hoisting device of the rotary crane to be mounted on the pylon with an inclined surface on the mount, such that when the mount rotates around the longitudinal axis of the pylon, the lifting gear attached to the pylon lifts the mount with its axial support surfaces from the pylon. Here too, simply by actuating the rotating gear the turntable as a whole and especially the upper mount can be lifted relative to the pylon. Preferably, however, provision is made for the above-described arrangement of the inclined surface on the pylon and the possibility of anchoring the lifting component on the mount, since advantages in terms of simplicity of design can thereby be achieved.

The rotary crane thus has a hoisting device for lifting the turntable or the upper mount relative to the pylon, with the hoisting device being driven by the rotating gear of the rotary crane. All that is needed is a lifting component which works together with the inclined plane, particularly in the form of a lifting pin anchored on an attachment device provided for that purpose. Actuation of the rotating gear produces the desired lifting or lowering of the mount of the facing support surface of the pylon.

In a further development of the invention, the pylon has at its upper end a flange-shaped annular surface extending radially on whose surface segmented bearings are positioned, on which the mount with its axial annular surface is supported, the bearings being fixed rigidly on the annular surface and being designed to be separable from it. This permits easy changing of the thrust bearing, which is subject to wear. After lifting the mount, all that is needed is to remove the worn axial bearing segments and replace them with new ones.

Preferably the bearings can rest in matching recesses on the flange-shaped annular surface of the pylon. Especially, retaining pieces in the form of cylindrical heads can be provided which, on the one hand fit precisely into recesses in the annular surface and on the other hand fit positively into lined-up recesses in the bearing blocks. The bearings and the annular surfaces thus have notches in the form of recesses for the retainer pieces, which, when the bearings fit precisely align together on the annular surfaces. This causes the bearing surfaces to be on the one hand attached adequately to the annular surfaces of the pylon and on the other hand to be easily replaced for maintenance purposes. The bearings thus do not have to be attached with, for example, screws.

In a further development of the invention, a support pin extends beyond the flange-shaped annular surface on the front of the pylon at its upper end. Said support pin is surrounded in ring fashion by the mount, and the mount with its radial support surface rests on said support pin. In a further development of the invention, the free end of the front annular surface of the support pin could be the seat of the inclined plane which allows the mount to be lifted axially. The inclined plane could fundamentally be located in another position. However, it is particularly advantageous if the contour of the support-pin front ascends toward the circumference, since the lifting component, especially a support pin, can then be positioned simply so that it will grip the inclined plane.

Especially, the mount can have a bearing guide immediately adjacent to the inclined plane, which can extend radially, so that the lifting component, especially a lifting pin transverse to the longitudinal axis of the pylon, can slide over the inclined plane. The lifting component can be slid forward and backward in the bearing guide. When pushed forward on the inclined plane, the lifting component projects beyond the bearing guide and extends over the inclined plane.

To distribute the active forces, preferably two attachment devices are positioned symmetrically on the mount so that two lifting components can be installed and can then run along two appropriate inclined planes. Especially, the mount can have as bearing guide two guide lugs with guide holes extending radially and positioned on an upper surface of the mount, that is, on the upper support-piece side when the mount is installed on the vertical pylon. Two lift pins can be inserted through the guide lugs, which preferably are diametrically opposite each other on the mount, so that the lift pins rest on two inclined planes provided on the pylon front, especially on its support pins.

To prevent the mount from tipping over as a result of wear of the radial support or as a result of manufacturing imprecision, in a further development of the invention the support-piece suspension equipment has a tip axis which extends transversely to the longitudinal axis of the pylon and allows the turntable to tip or swing on said tipping axis relative to the mount. The tipping axis is preferably perpendicular to a longitudinal center plane of the crane, which extends from the crane boom and the pylon. Tipping movements of the rotary crane occur, particularly in the longitudinal center plane because of the loads suspended on the crane boom, particularly in said longitudinal center plane, so that the tipping link between the mount and the turntable effectively ensures that a center-radial load is introduced on the thrust support and effectively prevents increased internal stresses because of distortion in the turntable. A certain amount of tipping is permitted and desired in order to counter increased internal stresses.

Preferably, the mount can have two support discs parallel to each other on opposite sides and positioned upright, having a circular-arc external contour and rigidly connected with the mount as a whole. The turntable rests on the circular-arc external contour of the support discs with complementary circular-arc recesses.

To prevent distortions in the upper support, the turntable is supported on the upper support exclusively by the mount on the pylon, and is in turn supported on said mount exclusively by the two support discs of the mount. Thus, there is especially no additional radial support between the turntable and the pylon on the upper support, for example below or above the mount. Also, the radial forces are borne exclusively through the hood-shaped mount.

Preferably the turntable does not have in the area of the upper support any cross-structure for the attachment of the mount. The turntable, which essentially can consist of two longitudinal arms extending along the sides of the pylon, is preferably suspended directly with the longitudinal arms on the circular-arc support discs of the mount. The side arms can have appropriate recesses for this purpose, preferably in the form of bowl-shaped shoulders projecting into the center, with which shoulders the turntable rests on the support discs of the mount. A cross-plate between the longitudinal arms for the purpose of attaching the mount can be dispensed with.

In a further development of the invention, the mount is designed in one piece. Between the pylon and the mount there are merely bearing blocks, made of a good friction-bearing material, and specifically bearing blocks which act radially and bearing blocks which act axially.

The mount can have a sleeve-shaped collar which surrounds a perimeter surface of the support pin at the end of the pylon, as well as a flange built in a single piece with the collar and protruding radially outward from the collar. An internal perimeter surface of the collar forms the radial support surface, on which the bearings can be positioned, and the support-piece flange forms the thrust bearing surface which rests on the corresponding bearings attached to the pylon. Attachment eyes can be provided as attachment devices for the lifting component, said attachment eyes being positioned on the collar at the end which faces the flange.

The invention is explained in greater detail by means of a preferred embodiment and associated drawings showing:

DESCRIPTION OF THE PREFERRED EMBODIMENTS

Figure 1:
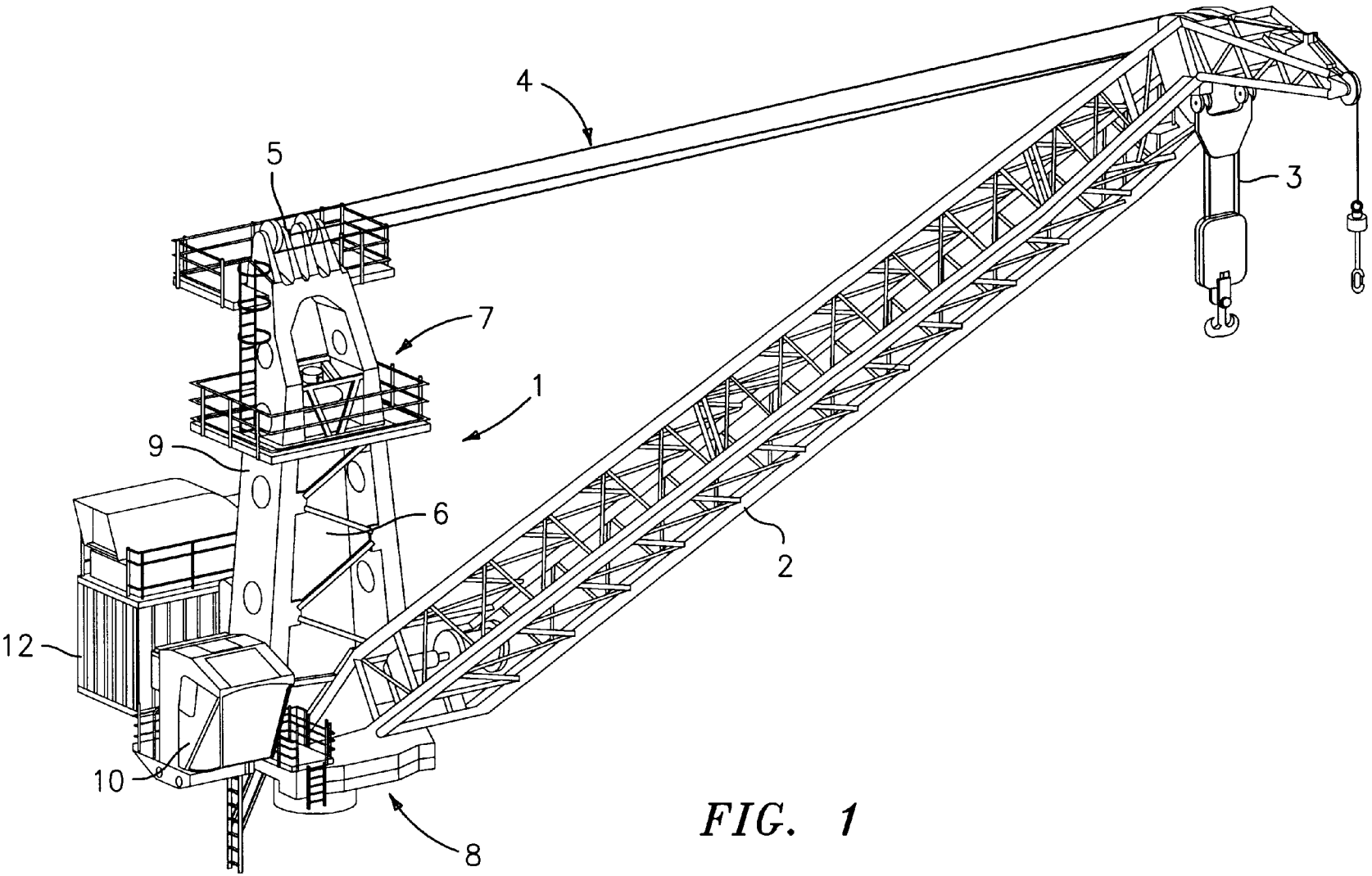
FIG. 1 A perspective view of an offshore crane of the king post type, represented schematically, which shows the turntable which is housed with a mounting frame to revolve on a firmly anchored pylon on a vertical axis, and houses a crane pylon which rocks around a horizontal axis.

The king-post type of offshore crane shown in FIG. 1 has a turntable 1 housed to revolve on a vertical axis, on which a crane boom 2 is jointed to rock around a horizontal axis. Above the projecting end of crane boom 2 there is a lifting cable 3 on which a crane hook and similar equipment can be attached. The crane boom 2 is supported on a support cable 4 which is guided over a tip segment 5 of turntable 1.

Figure 2:
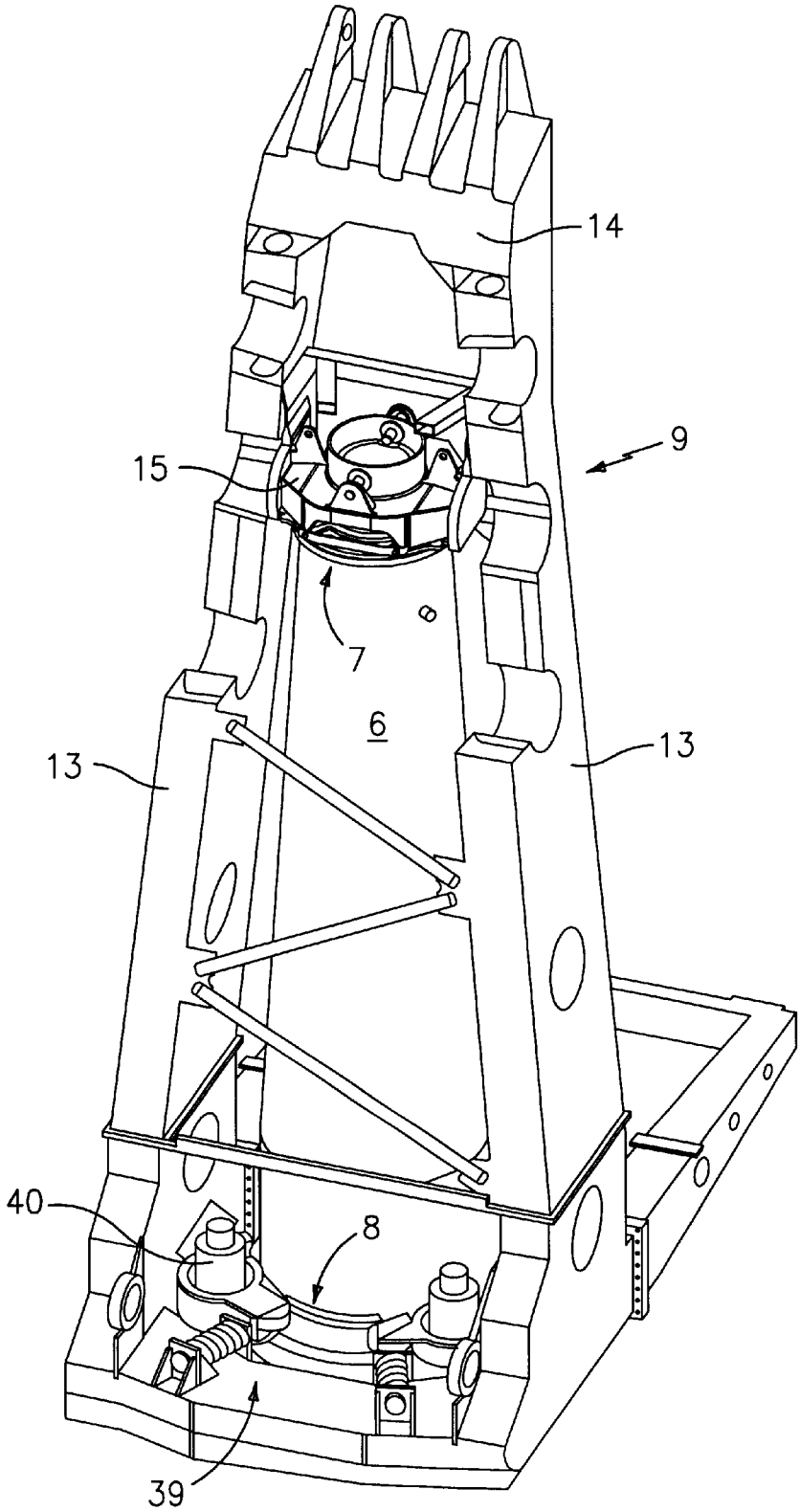
FIG. 2 A perspective view of the mounting frame of the turntable in a partial sectional representation, in which the mounting frame is housed to rotate on the pylon by means of an upper support at the upper end of the pylon and a lower support at the foot of the pylon.

The turntable 1 is housed on a pylon 6 which with its longitudinal axis extends vertically and is rigidly anchored on a support foundation, for example a floor plate, a platform, or similar foundation. The turntable 1 is held on the pylon 6 by means of an upper support 7 located in the area of the upper end of pylon 6, and by means of a lower support 8 in the foot area of the pylon 6, in such manner that turntable 1 can revolve on the pylon (cf. FIG. 2). While the lower support 8 can be a purely radial support, upper support 7 preferably includes both a radial support and an axial support which supports rotary platform 1 also in the longitudinal direction of pylon 6. As shown in FIG. 1, turntable 1 includes a mounting frame 9 which sits like a bell on pylon 6. On mounting frame 9 there are various superstructures, in addition to couplers for crane boom 2. They can include an operator's cabin 10 as well as mechanical superstructures 12 such as cable drums, counterweights, drive assemblies, etc., in the back. As shown in FIG. 2, mounting frame 9 consists essentially of two separate longitudinal or side arms 13 which extend essentially vertically and which are joined at their upper, yoke-fashion, by a common head piece 14. In the area of upper support 7 the mounting frame is suspended from a mount 15 positioned at the upper of, and capable of rotating on, pylon 6.

Figure 7:
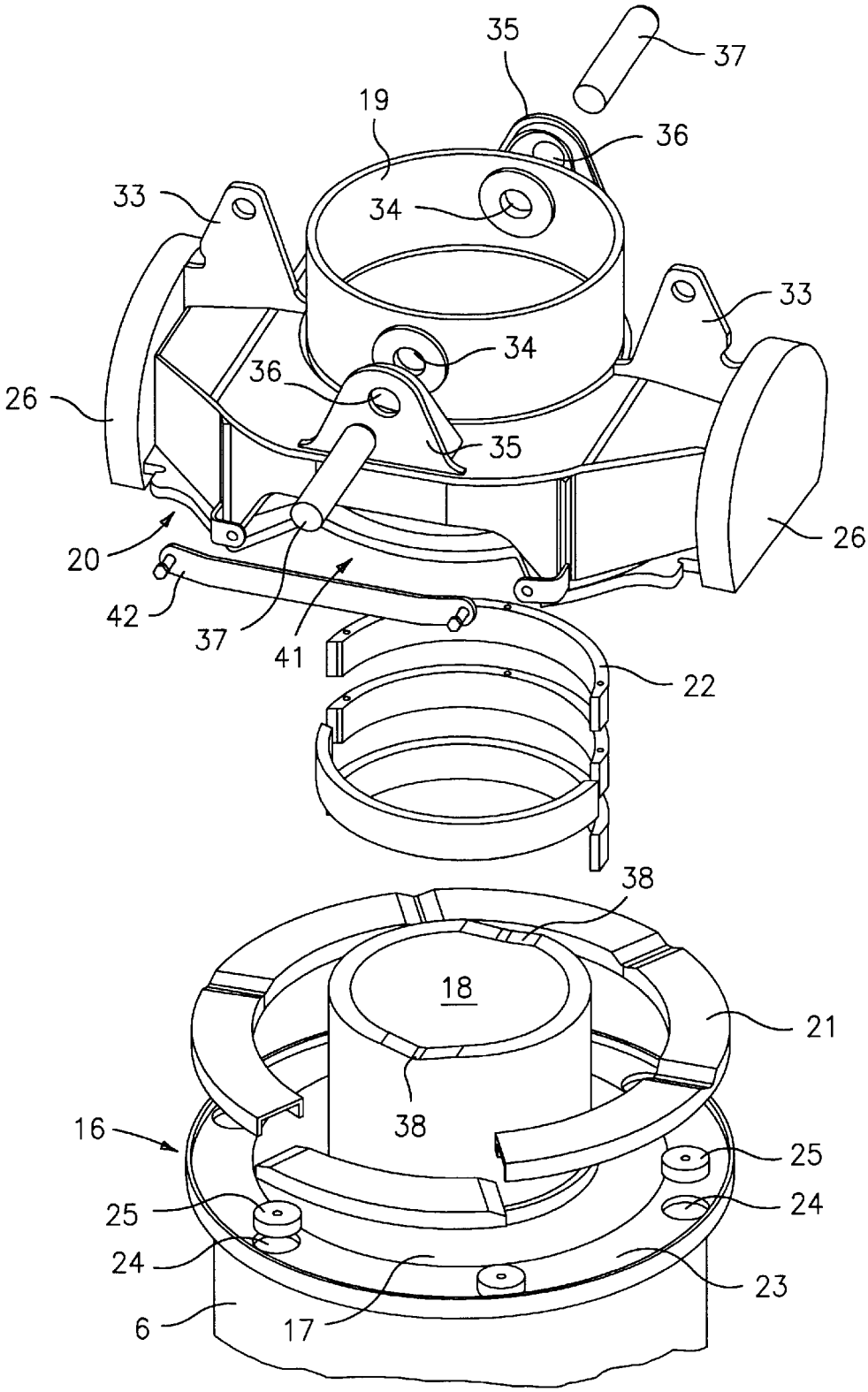
FIG. 7 An exploded view of the upper support of the mounting frame of the turntable on the pylon, showing especially the mount and the bearing positioned between the mount and the pylon.

As shown in FIG. 7, pylon 6 has at its upper end a step-like shoulder 16. An annular flange surface 17 extends radially to the longitudinal axis of pylon 6, and is essentially flat. Coaxial to the longitudinal axis of pylon 6, a circular-cylindrical support pin 18 extends from the center of annular surface 17 and serves as support for mount 15.

Mount 15 (cf. FIG. 6) has a collar 19 with an essentially cylindrical internal perimeter surface, as well as a flange 20 which extends radially outward, which is positioned at the bottom end of collar 19 and is built in one piece with or is welded to collar 19. Mount 15 is clinched over support pin 18 of pylon 6, so that collar 19 encloses the sleeve surface of support pin 18 and flange 20 rests on annular surface 17 of the pylon. The internal perimeter surface of collar 19 thus forms a radial bearing surface for the radial support of the mount, and the floor surface of flange 20 forms an axial bearing surface for the axial support of mount 15.

Figure 6:
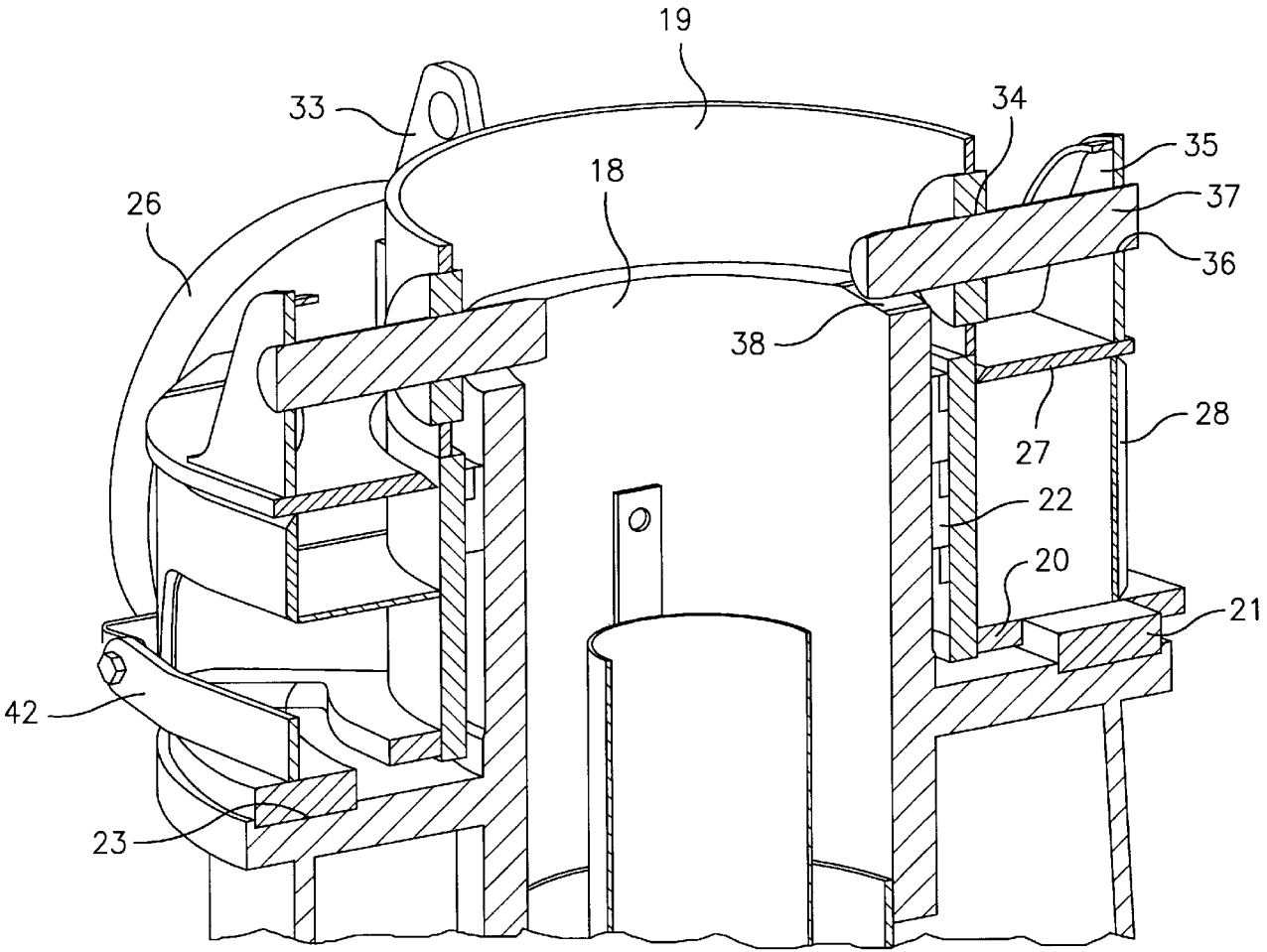
FIG. 6 A perspective view of the mount of the upper support positioned on the pylon, in cross-section.

To improve the ability of mount 15 to rotate on the pylon, there are two bearings 21 and 22 between mount 15 and pylon 6. On the one hand axially-acting, circular-arc segmented bearings 21 lie on annular surface 17 of pylon 6; they are essentially disc-shaped, and are bent in a circular arc. As shown in FIGS. 6 and 7, in the upper surface of annular flange 17 of the contour of the bearings 21 there are appropriate grooves or recesses 23, into which the bearings 21 fit exactly. To hold the bearings 21 immovably, there are additional recesses in the annular flange surface 17, in the form of milled openings 24. Complementary millings 24 are provided in the underside of bearings 21, which are covered with the millings in annular surface 17. In said millings 24 there are retainer components in the form of cylindrical discs 25, which hold the bearings 21 in an exact fit and in permanent position. As shown in FIG. 7, the bearings 21 are complemented by a friction-bearing ring which is subdivided into a total of six bearing segments.

The radially acting bearings 22 lie between collar 19 and the sleeve surface of support pin 18. Inside collar 19 there are preferably sockets to hold the bearings 22. The bearings 22 are circular-arc segments which complement each other to form rings of bearing material (cf. FIG. 7).

Figure 5:
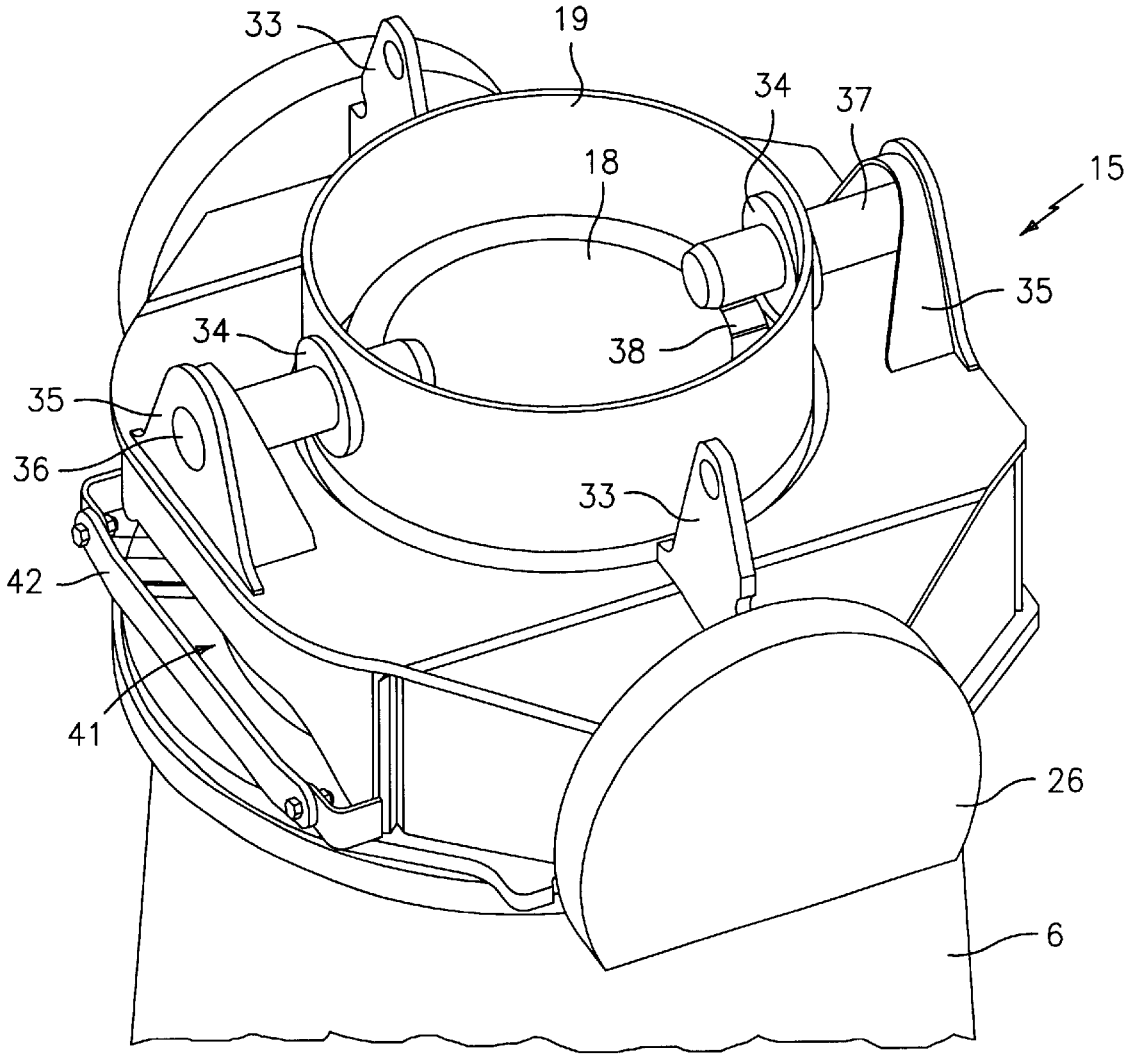
FIG. 5 A perspective view of the mount of the upper support positioned on the pylon.

At a distance radially from collar 19, mount 15 has support discs 26, positioned upright, i.e. essentially parallel to the longitudinal axis of collar 19, and positioned diametrically opposite each other. As shown in FIG. 5, the support discs 26 have a circular-arc external contour facing the upper of mount 15. Support discs 26 are positioned parallel to each other. They are welded to the main body of mount 15. As shown in FIG. 6, mount 15 is designed as a box structure. Parallel to and above bottom radial flange 20, which forms the axial support surface of mount 15, there is a parallel flange 27, likewise extending out radially from collar 19, and welded to collar 19. The external circumferences of flanges 20 and 27 are connected by means of an appropriate axial bridge 28. Support discs 26 are welded to the outer circumference of flanges 20 and 27.

Figure 3:
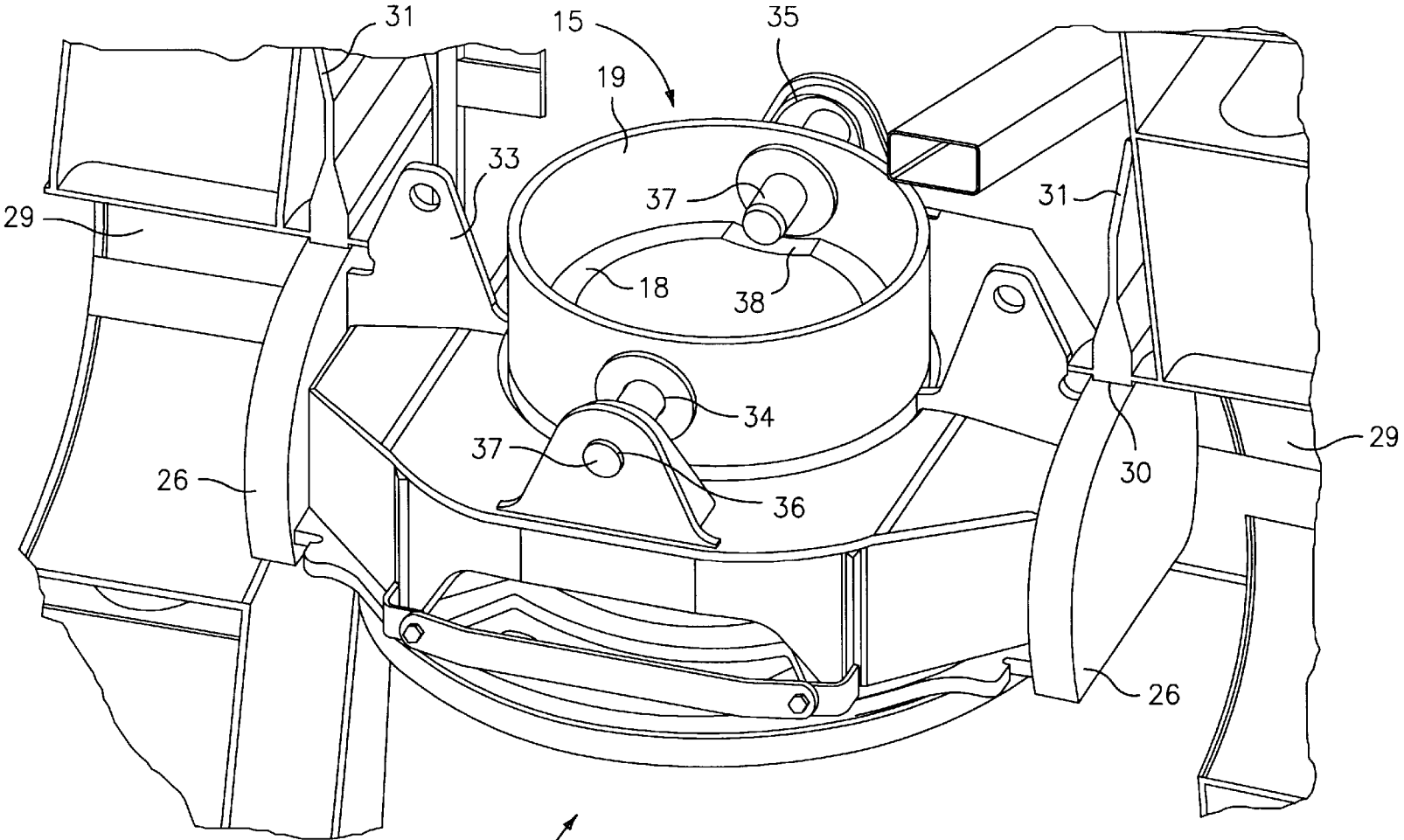
FIG. 3 A perspective view of the upper support of the mounting frame on the pylon in a partial cross-section, which shows a mount positioned to rotate on the pylon and its connection with the mounting frame.
Figure 4:
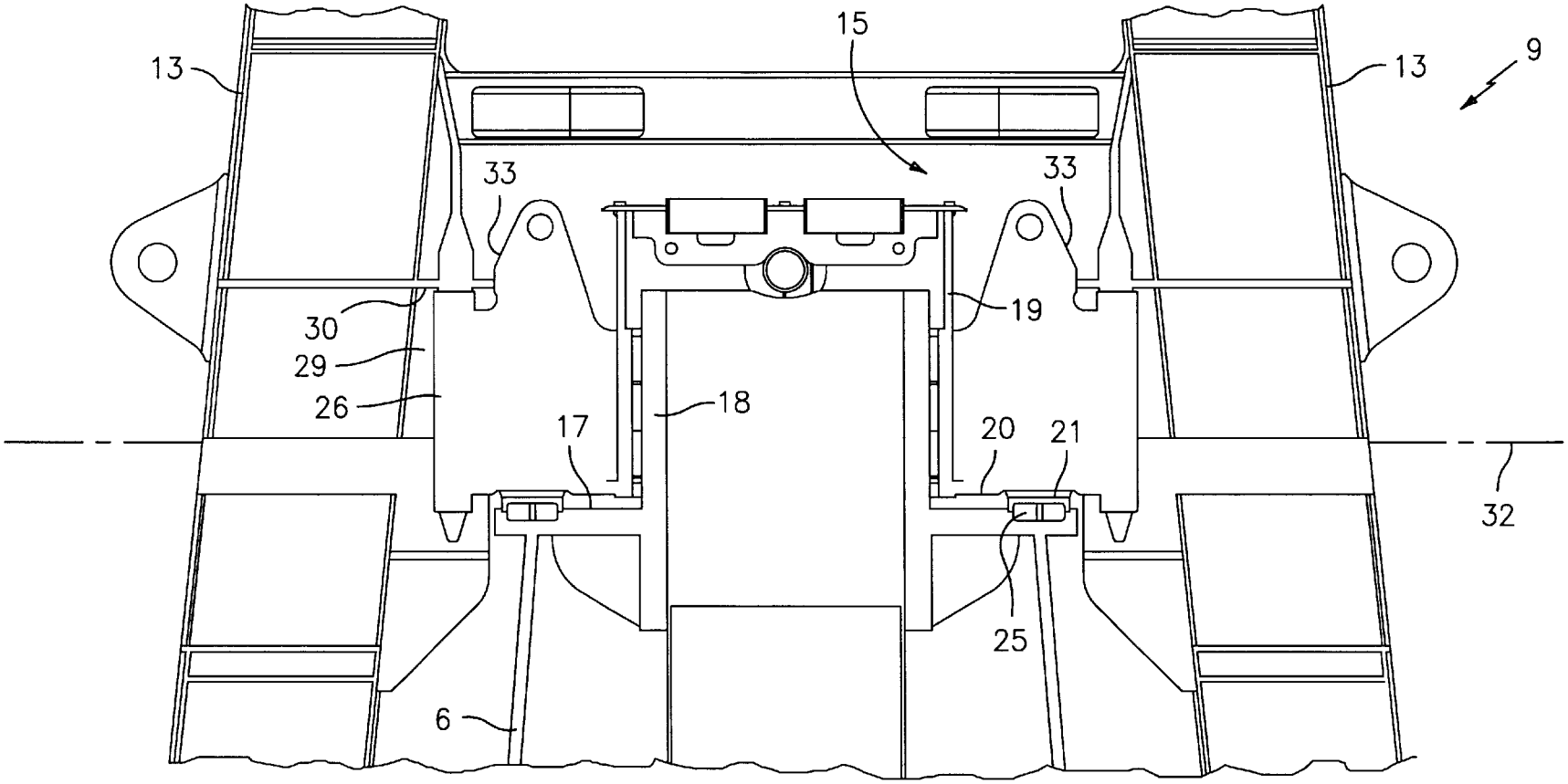
FIG. 4. A longitudinal cross-section of the upper support of the preceding figures through the longitudinal axis of the pylon.

As shown in FIGS. 3 and 4, mounting frame 9 of turntable 1 is suspended from support discs 26. Side arms 13 of mounting frame 9 have support recesses 29, the internal circumference of which is similarly bent to form a circular arc, by means of which they rest on the exterior contour of support discs 26. Bearing recesses 29 are formed of cross-tubes welded into side arms 13, the tops of which cross-tubes extend like shoulders toward the mount 15 (cf. FIG. 3). The projecting, dish-shaped support shoulders 30 are supported on the top by supporting bridges 31 on the longitudinal holders or side arms 13 (cf. FIGS. 3 and 4).

The support of turntable 1 on support discs 26 and the complementary support recesses 29 in mounting frame 9 permit mounting frame 9 to tip toward mount 15. The corresponding tipping axis 32 extends perpendicular to the longitudinal center plane of the crane, which is defined by crane boom 2 and the vertical rotation axis of pylon 6.

Said support discs 26 of mount 15 form the only connection between mount 15 and mounting frame 9 of turntable 1. Only centering stops 33 are provided on the top of mount 15 to prevent mounting frame 9 from sliding parallel to tipping axis 32 and relative to mount 25. As shown in FIG. 4, centering stops 33 form a cone with tip at the top, so that when turntable 1 is positioned from above on support discs 26, it assumes the correct position of its own accord. Centering stops 33 are designed in the form of perpendicular plates. They work together with the ends of support shoulders 30 on mounting frame 9.

As shown in FIG. 5, on the upper edge of collar 19 there are through holes which form support eyes 34. Additionally, lugs 35 are welded to the upper of mount 15, offset radially outward from collar 19. In the lugs 35 there are through holes which align with support eyes 34 in collar 19 and also form support eyes 36. Lift pins 37 can be inserted through lined-up support eyes 34 and 36. They can be pushed through support eyes 34 or 36 on the inside of collar 19 in such manner that they project inward from the interior perimeter surface of collar 19 (cf. FIG. 5). Support eyes 34 and 36 thus form a bearing guide for lift pins 37. Support eyes 36 can also be threaded so that the lift pins can be screwed in.

When fully inserted, lift pins 37 work together with inclined planes on pylon 6 to slide bearing mount 15, when rotated, around pylon 6 axially to the pylon. Concretely, the mount 15 and hence turntable 1 is lifted as a unit. As shown in FIG. 7, in the front surface of support pin 18 of pylon 6 there are diametrically opposite facing cavities 38, which rise ascend in the circumferential direction on both sides;

that is, the sides of cavities 38 form a thread for the lift pin or pins 37. Support eyes 34 and 36 are positioned and oriented in such manner that the lift pins can simply be inserted when the support eyes are aligned with cavities 38 on the front of the support pin 18. The lift pins 37 then extend into the cavities 38.

To lift mount 15, the turntable 1 need merely be rotated around pylon 6. This can be done by means of rotating gear 39, provided essentially for the purpose of rotating turntable 1 on pylon 6. As shown in FIG. 2, the rotating gear preferably has at the bottom end of mounting frame 9 rotary drives 40, which are housed on mounting frame 9 and which work together with a ring gear positioned around the pylon.

In normal operation, lift pins 37 are of course removed from support eyes 34 or 36, or are withdrawn sufficiently therefrom that they do not protrude inward over collar 19. Rotation of mounting frame 9 and hence of mount 15 has no effect. If maintenance is required for upper support 7, turntable 1 is first positioned in such manner that support holes 34 and 36 align with cavities 38 in support pin 18. Lift pins 37 are then inserted into support eyes 34 and 36 so that they lie above the front of the support pin 18 near cavity 38, as shown in FIG. 5. The rotating gear is then activated, and turntable 1 revolves together with mount 15 on the longitudinal axis of pylon 6. Lift pins 37 run along the inclined planes formed by the sides of cavities 38, and lift bottom mount 15 axially from pylon 6, or, more precisely from annular surface 17. The axially acting bearings 21 thereupon become accessible for replacement. To facilitate this task, a sufficiently large recess 41 can be provided on the external circumference side of mount 15, through which recess 41 the corresponding bearing 21 can be removed. Rotating turntable 1 piece-by-piece, aligns maintenance recess 41 sequentially with each bearing 21. In normal operation recess 41 is covered by a cover 42.

What is claimed is:

1. Rotary crane, comprising a pylon structured and arranged to be anchored on a floor plate, platform, or base, a turntable housed to revolve on a longitudinal axis of the pylon by an upper support and a lower support, a crane boom supported by the turntable, and a gear for rotating the turntable on the pylon, the upper support of the rotary stage having a mount which is positioned on an upper end section of the pylon and which is structured and arranged to rotate, and said mount having an axial support surface for axial support on the pylon, a radial support surface for radial support on the pylon, and suspension equipment for suspending the turntable, wherein an inclined plane is provided on the pylon and a lifting component is structured and arranged to be attached to the mount, said lifting component running along the inclined plane when said support is rotated on the longitudinal axis of the pylon, thereby lifting the mount with its axial support surface from the pylon.

2. Rotary crane according to claim 1, in which the pylon comprises, on an upper end section thereof, a flange-shaped, radially extending annular surface on which segmented bearings are positioned, said bearings structured and arranged to support the mount with its axial support surface thereon, and said bearings structured and arranged to be retained on the annular surface in such a manner that the bearings cannot slide and are detachable from the annular surface.

3. Rotary crane according to claim 2, in which the bearings are held on the annular surface by retainer pieces, which fit into recesses in the annular surface.

4. Rotary crane according to claim 1, in which the bearings are held on the annular surface by retainer pieces, which fit into recesses in the annular surface.

5. Rotary crane according to claim 1, in which the upper end section of the pylon comprises a support pin structured and arranged to project in the longitudinal direction of the pylon and which is surrounded annularly by said mount, said support pin having a front annular surface on which said inclined plane is arranged.

6. Rotary crane according to claim 1, in which the mount has a bearing guide for the lifting component, which is positioned immediately adjacent to the inclined plane and extends radially, so that the lifting component can be slid transversely to the longitudinal axis of the pylon over the inclined plane.

7. Rotary crane according to claim 1, in which the mount comprises an upper surface having two guide lugs arranged opposite one another and guide hole extending radially therethrough, and comprising two lifting components in the form of pins or bolts and structured and arranged to be inserted through said guide holes, such that said pins or bolts lie above two inclined planes formed on a top of said pylon.

8. Rotary crane according to claim 1, wherein suspension equipment for the mount of the rotary crane has a tipping axis structured and arranged to extend transversely to the longitudinal axis of the pylon, such that the turntable is structured and arranged to tilt relative to the mount on the tipping axis thereof.

9. Rotary crane according to claim 1, in which the mount has two parallel upright support discs with circular-arc external contour on which the turntable is suspended with matching circular-arc recesses.

10. Rotary crane according to claim 9, in which the turntable is supported on the upper support exclusively by the mount on the platform and is supported on the mount exclusively by the two support discs of the mount.

11. Rotary crane according to claim 1, in which the mount is in one piece and only bearing blocks made of a friction-bearing material are provided between the pylon and the mount.

12. Rotary crane according to claim 1, in which the mount comprises a sleeve-shaped collar surrounding a perimeter surface of the pylon, and a flange produced in a single monolithic piece with said collar, said flange extending radially outwardly from the collar, an internal perimeter surface of said collar forming the radial support surface of said mount, and the outwardly extending flange forming the axial support surface of the mount, and said lifting component structured and arranged to be inserted into attachment ears positioned on an end of the collar facing the flange.

13. Rotary crane, comprising a pylon structured and arranged to be anchored on a floor plate, platform, or base, a turntable housed to revolve around a longitudinal axis of the pylon by an upper support and a lower support, a crane boom supported by the turntable, and a gear for rotating the turntable around the pylon, the upper support of the rotary stage having a mount which is positioned on an upper end section of the pylon and which is structured and arranged to rotate, said mount having an axial support surface for axial support on the pylon and a radial support surface for radial support on the pylon, and suspension equipment for suspending the turntable, wherein attachment equipment for anchoring a lifting component is provided on the pylon and an inclined plane is provided on the mount, such that, when the mount is rotated, the inclined plane runs along the longitudinal axis of the pylon on the lifting component and lifts the mount with its axial support surface from the pylon.

14. Rotary crane according to claim 13, in which the pylon comprises, on an upper end section thereof, a flange-shaped, radially extending annular surface on which segmented bearings are positioned, said bearings structured and arranged to support the mount with its axial support surface thereon, and said bearings structured and arranged to be retained on the annular surface in such a manner that the bearings cannot slide and are detachable from the annular surface.

15. Rotary crane according to claim 13, in which the bearings are held on the annular surface by retainer pieces, which fit into recesses in the annular surface.

16. Rotary crane according to claim 13, in which the bearings are held on the annular surface by retainer pieces, which fit into recesses in the annular surface.

* * * * *